US011933203B2

(12) United States Patent
Saggam et al.

(10) Patent No.: US 11,933,203 B2
(45) Date of Patent: Mar. 19, 2024

(54) LOST MOTION MECHANISMS AND ACTUATORS

(71) Applicant: Eaton Intelligent Power Limited, Dublin (IE)

(72) Inventors: Nikhil Saggam, Maharashtra (IN); Siddesh Kapdi, Maharashtra (IN); Suhrud Purohit, Maharashtra (IN); Matthew A. Vance, Marshall, MI (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/996,796

(22) PCT Filed: Apr. 21, 2021

(86) PCT No.: PCT/EP2021/025149
§ 371 (c)(1),
(2) Date: Oct. 21, 2022

(87) PCT Pub. No.: WO2021/213703
PCT Pub. Date: Oct. 28, 2021

(65) Prior Publication Data

US 2023/0184144 A1 Jun. 15, 2023

(30) Foreign Application Priority Data

Apr. 21, 2020 (IN) ..... 202011017088
Sep. 18, 2020 (IN) ..... 202011040522

(51) Int. Cl.
*F01L 13/00* (2006.01)
*F01L 1/18* (2006.01)
(Continued)

(52) U.S. Cl.
CPC ..... *F01L 13/0005* (2013.01); *F01L 1/18* (2013.01); *F01L 1/46* (2013.01); *F01L 1/146* (2013.01);
(Continued)

(58) Field of Classification Search
CPC ... F01L 1/146; F01L 1/267; F01L 1/46; F01L 2001/467; F01L 13/0005; F01L 2013/001; F01L 2800/031
(Continued)

(56) References Cited

U.S. PATENT DOCUMENTS 6,688,266 B1 2/2004 Church et al.
2002/0014217 A1* 2/2002 Church ..... F01L 1/146 123/90.43
(Continued)

FOREIGN PATENT DOCUMENTS

WO 2019/036272 A1 2/2019
WO 2019/133658 A1 7/2019

OTHER PUBLICATIONS

International Search Report issued in corresponding application No. PCT/EP2021/025149 dated Sep. 22, 2021, 6 pages.
(Continued)

*Primary Examiner* — Jorge L Leon, Jr.
(74) *Attorney, Agent, or Firm* — Pearne & Gordon LLP

(57) ABSTRACT

A lost motion mechanism can comprise a castellation device, comprising a casing, an upper castellation, and a lower castellation. The casing can comprise a first linear slot and a second linear slot perpendicular to the first linear slot. Upper castellation can comprise an upper body, spaced upper teeth extending from the upper body, the spaced upper teeth forming spaced upper gaps therebetween, and an actuation peg extending from the upper body into the first linear slot. Lower castellation can comprise a lower body,
(Continued)

spaced lower teeth extending from the lower body, the spaced lower teeth forming spaced lower gaps therebetween, and an anti-rotation peg extending from the lower body into the second linear slot. An actuator can be configured with the lost motion mechanism so that a movable arm comprises a forked end configured to move on the actuation peg as the movable arm swivels.

20 Claims, 10 Drawing Sheets

(51) Int. Cl.
*F01L 1/46* (2006.01)
*F01L 1/14* (2006.01)
*F01L 1/26* (2006.01)

(52) U.S. Cl.
CPC ..... *F01L 1/267* (2013.01); *F01L 2001/467* (2013.01); *F01L 2013/001* (2013.01); *F01L 2820/031* (2013.01)

(58) Field of Classification Search
USPC ..... 123/90.39, 90.61
See application file for complete search history.

(56) References Cited

U.S. PATENT DOCUMENTS

| | | | | |
|---|---|---|---|---|
| 2009/0199803 | A1* | 8/2009 | Hendriksma | F01L 1/245 123/90.55 |
| 2012/0186546 | A1* | 7/2012 | Cecur | F02D 13/04 123/90.15 |
| 2018/0187579 | A1 | 7/2018 | Cecur | |
| 2020/0003085 | A1* | 1/2020 | Baltrucki | F01L 1/181 |
| 2020/0182108 | A1* | 6/2020 | VanWingerden | F02D 13/04 |

OTHER PUBLICATIONS

Written Opinion issued in corresponding application No. PCT/EP2021/025149 dated Sep. 22, 2021, 11 pages.

* cited by examiner

LOST MOTION MECHANISMS AND ACTUATORS

CROSS-REFERENCE TO RELATED APPLICATIONS

This is a National Stage application of PCT international application PCT/EP2021/025149 filed on Apr. 21, 2021, which claims priority to Indian Patent Application No. 202011017088, filed Apr. 21, 2020, and Indian Patent Application No. 202011040522, filed Sep. 18, 2020, which are incorporated herein by reference in their entireties.

FIELD

A lost motion mechanism can comprise a castellation device that can maintain lash and that can be switched to provide a locked state and an unlocked state. The unlocked state can enable lost motion for cylinder deactivation. The castellation device can be switched by an actuator.

BACKGROUND

Variable valve actuation provides many benefits. It is possible to switch between engine braking and nominal operation, or it is possible to switch between one lift height and another, including a zero lift. But, the packaging can be complex or can have a large footprint.

SUMMARY

Cylinder deactivation ("CDA") can be used for thermal gas management & fuel efficiency benefits. The current disclosure describes mechanisms to achieve CDA. But, other variable valve actuation ("VVA") techniques can be achieved, including engine braking, early or late valve opening or closing, among others.

An electromagnetically-actuated castellation device is shown and described with methods for actuating. A system for electromagnetic unlatching is also shown and described with methods for actuating. These can be assembled as part of a deactivating pushrod assembly. Cylinder deactivation can then be implemented on a pushrod assembly. A system comprising electromagnetic actuation can be used for selectively engaging or disengaging a lost motion mechanism. The system can comprise an inverted deactivation.

A lost motion mechanism can comprise a castellation device, comprising a casing, an upper castellation, and a lower castellation. The casing can comprise a first linear slot and a second linear slot perpendicular to the first linear slot. Upper castellation can comprise an upper body, spaced upper teeth extending from the upper body, the spaced upper teeth forming spaced upper gaps therebetween, and an actuation peg extending from the upper body into the first linear slot. Lower castellation can comprise a lower body, spaced lower teeth extending from the lower body, the spaced lower teeth forming spaced lower gaps therebetween, and an anti-rotation peg extending from the lower body into the second linear slot.

An actuator can be configured with the lost motion mechanism so that a movable arm comprises a forked end configured to move on the actuation peg as the movable arm swivels.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DETAILED DESCRIPTION

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures.

A pushrod engine, also called a Type V engine, aims at achieving cylinder deactivation. It does so using an actuator 30, 130 which can either engage or disengage a lost motion mechanism. The lost motion mechanism comprises a castellation device 21, 22, 211, 212 or a latch device 41.

Figure 1A:
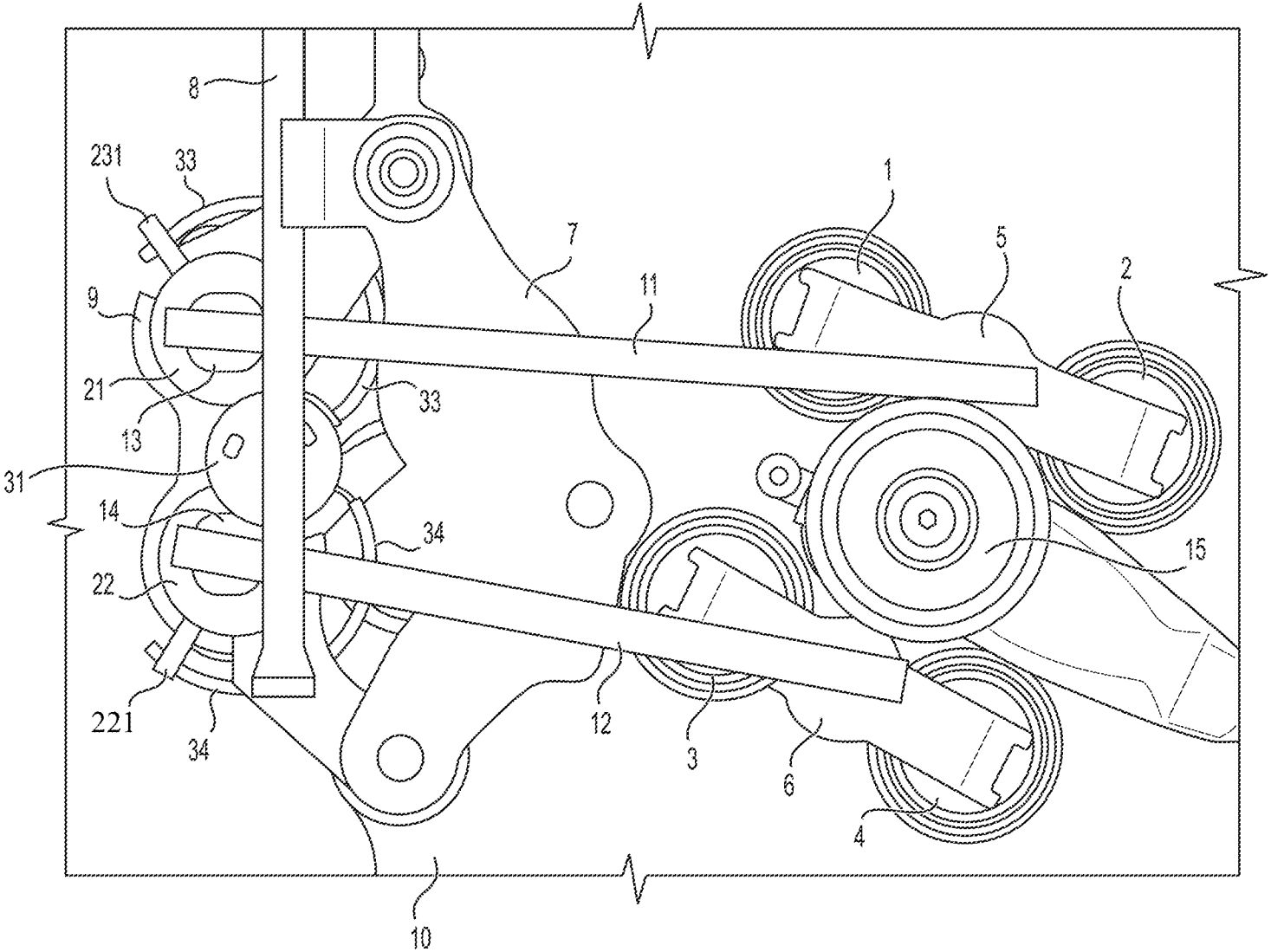
FIGS. 1A & 1B are views of a portion of a valvetrain on an engine comprising a lost motion mechanism and actuator.
Figure 1B:
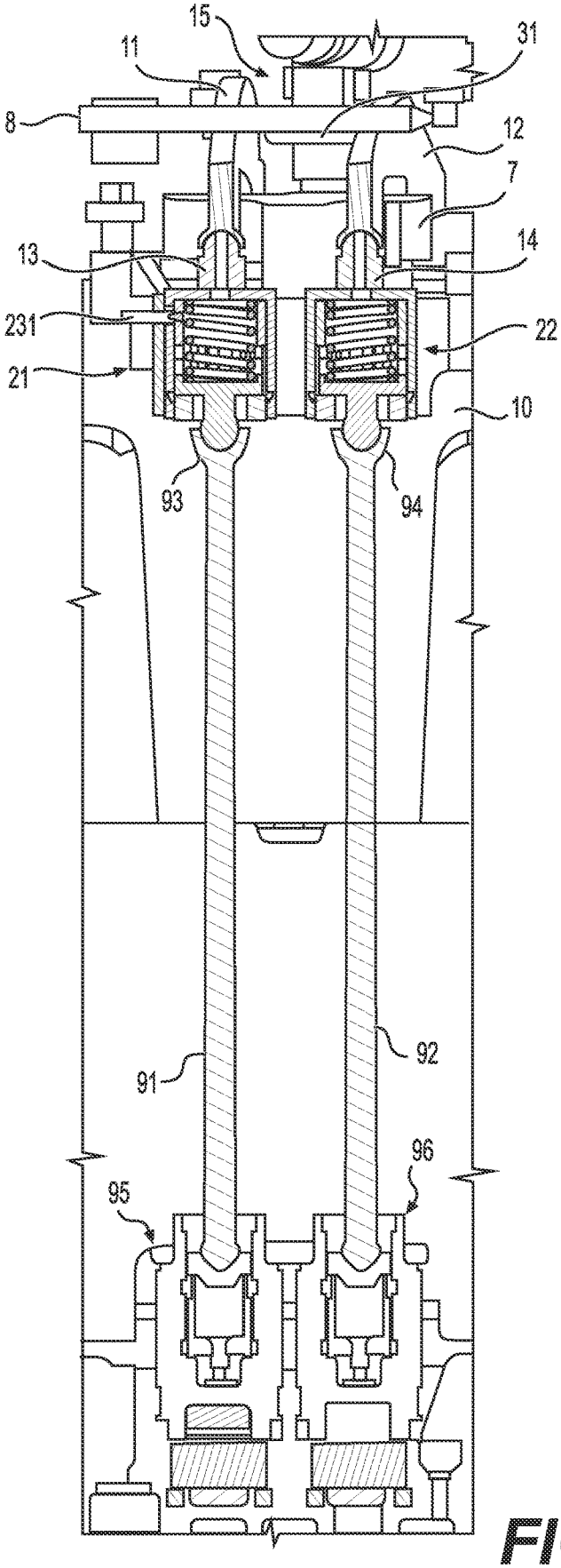
Figure 2A:
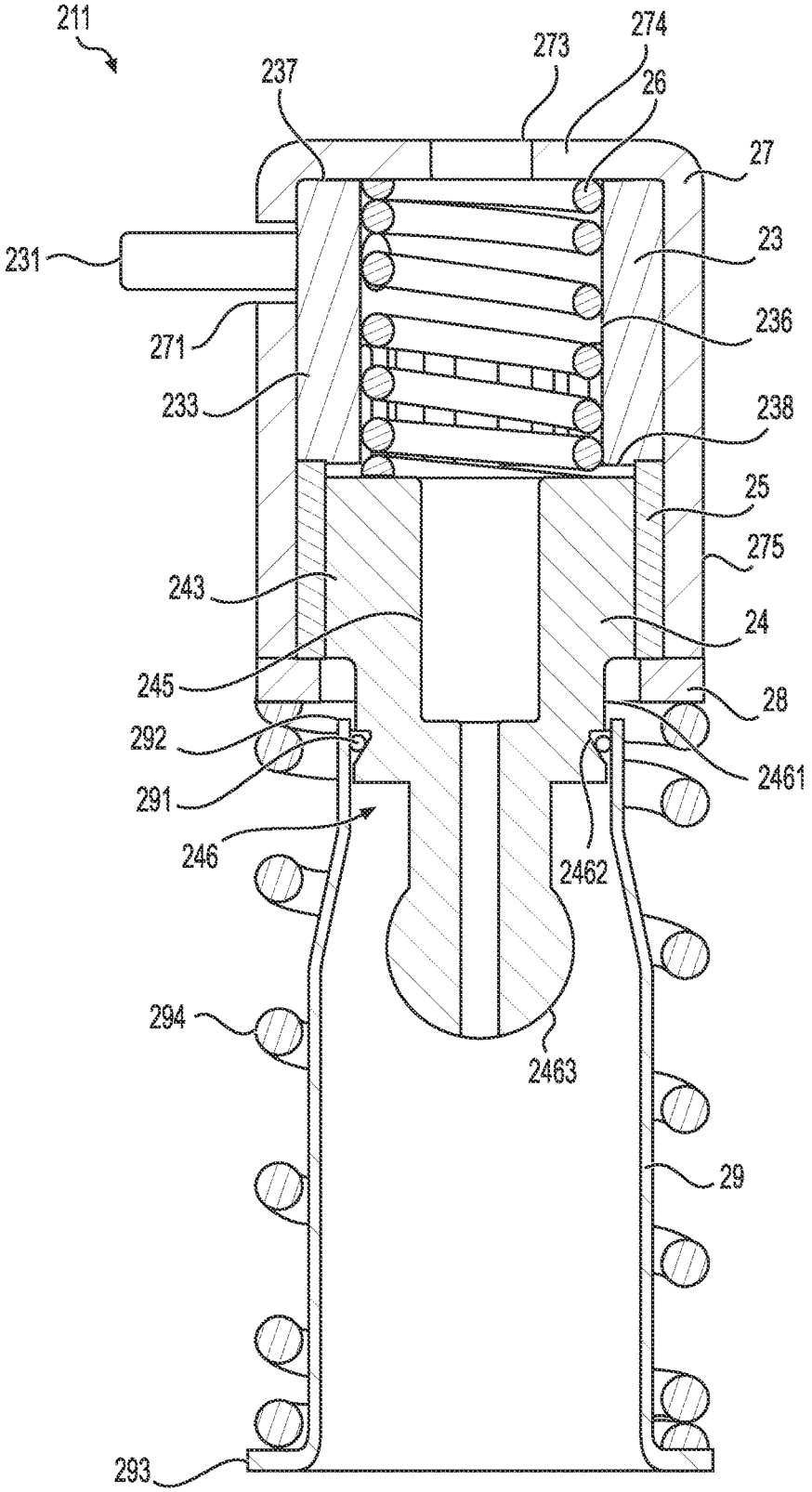
FIGS. 2A-2C are views of alternative lost motion mechanisms comprising castellation devices.
Figure 2B:
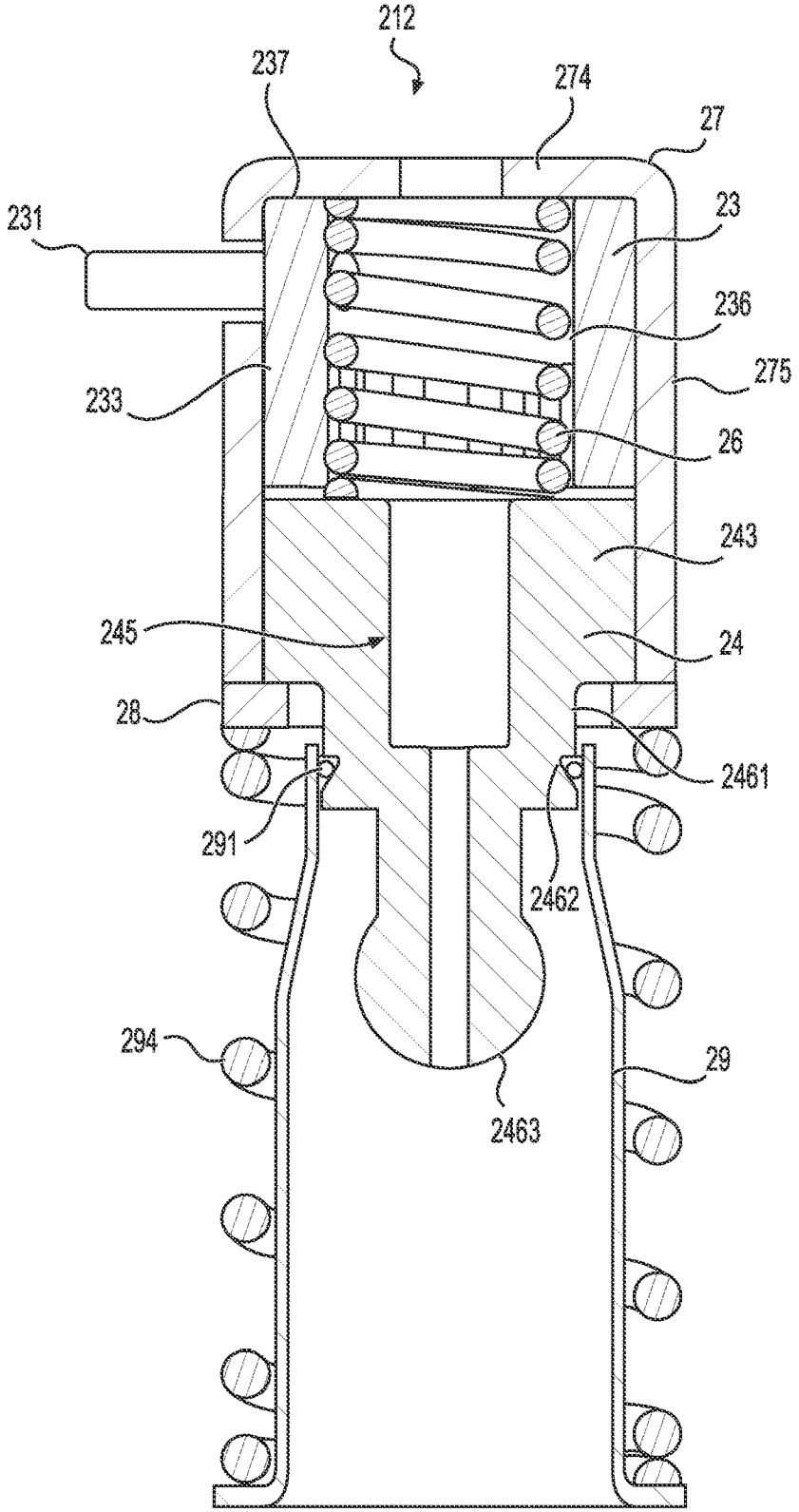
Figure 2C:
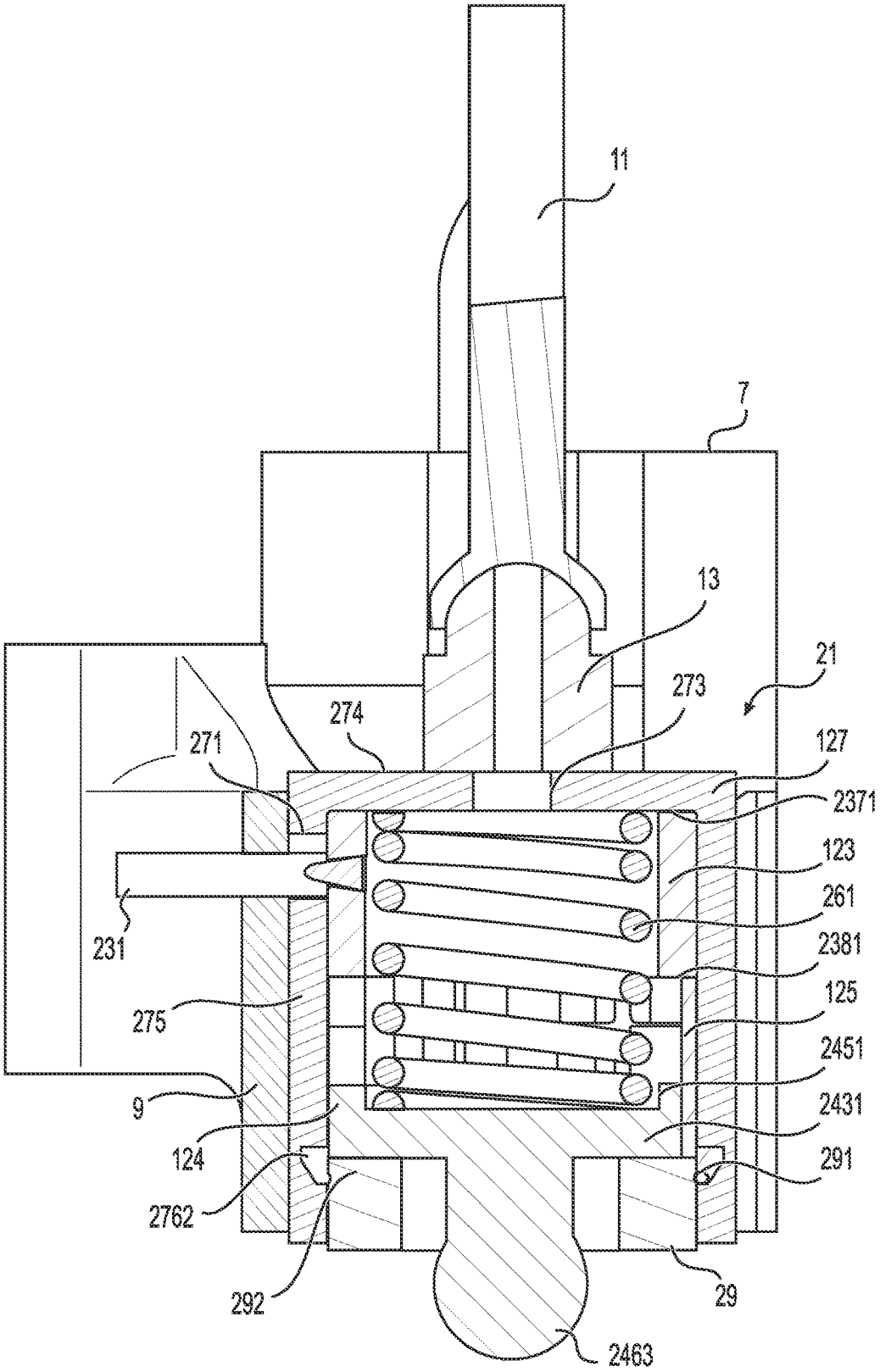

FIGS. 1A & 1B are views of a portion of a valvetrain on an engine comprising a lost motion mechanism and actuator 30. A portion of the engine block 10 is shown. Engine block 10 can comprise portions for other cylinders and other valvetrain actuation devices. A representative cylinder can include a fuel injector 15 positioned near a pair of intake valves 1, 2 and a pair of exhaust valves 3, 4. Valve bridges 5, 6 can receive actuation forces from rocker arms 11, 12. Bridge tilt functionality can be enabled because of the lash maintained by the castellation devices 21, 22, 211, 212. A carrier 7 can be used to position the rocker arms 11, 12. This portion of the valvetrain is representative, and different numbers of valves and different rocker arm configurations can be substituted.

A pair of rocker arms 11, 12 are actuated by a pair of pushrods 91, 92 when the castellation devices 21, 22 are in locked positions. Other castellation devices 211, 212 can be substituted for the castellation devices 21, 22. Lifters 95, 96 can ride on cams that can rotate to transfer valve lift profiles according to the timings of the cam lobes. However, when the castellation devices 21, 22, 211, 212 are unlocked, the lower castellation 24, 124 can be pushed to slide into the upper castellation 23, 123. The upward sliding can constitute an inverted deactivation. Instead of the valve lift profiles being transferred through the rocker arms 11, 12 to the valves 1-4, the valve lift profiles are lost inside the castellation devices 21, 22, 211, 212.

Other VVA techniques place a castellation device or other mechanism in the fulcrum of the rocker arm 11, 12. In this example, the carrier 7 would house the castellation device. But, in this disclosure, the castellation devices 21, 22, 211, 212 are placed under the pivot end of the rocker arm. A ball-and-socket arrangement at the pivot end of the rocker arm 11, 12 is formed by a rounded prop 13, 14 and cupped ends to the rocker arms 11, 12. The props 13, 14 are set on top of the castellation devices 21, 22, 211, 212. Props 13, 14 can be select-fit for the application.

A castellation carrier 9 can be mounted to the engine block 10. Castellation carrier 9, carrier 7, and rail 8 are sometimes referred to as part of a tower assembly used to mount a valvetrain. Tower is simplified and can comprise additional aspects known in the art.

Castellation carrier 9 mounts castellation devices 21, 22, 211, 212 relative to the pushrods 91, 92 and rocker arms 11, 12. Castellation carrier 9 can comprise receptacles 191, 192 for drop-in assembly of the castellation devices 21, 22, 211, 212. Certain of the casing features can be copied to the castellation carrier 9. For example, the linear slots 271, 272 can be mirrored in carrier slots 195, 196, 193. The casing features and mirroring castellation carrier features can stabilize the castellation devices 21, 22, 211, 212 so that the props 13, 14 have stable positioning with respect to the rocker arms 11, 12. The casing 27 can have a top 274 with an oil port 273 for lubrication flow-through. A tubular body 275 can have a casing height that sets a first length between the props 13, 14 and pushrods 91, 92. The actuation peg 231, 221 extending from the upper castellation 23, 123 prevents the upper castellation 23, 123 from moving in the casing 27 and comports with stable positioning of the props 13, 14.

But, it is beneficial to account for lash in a valvetrain. The castellation devices 21, 211, 211, 212 facilitate maintaining lash. Lash is a designed-for gap that allows for heat expansion and contraction while ensuring that the valves 1-4 are closed when they should be. To this end, the lower castellation 24, 124 can drop down away from the upper castellation 23, 123 or can rise towards it, thereby maintaining the designed-for gap. A washer 28 is biased by a pushrod spring 294. A pushrod sleeve 29 includes a rim 293. Pushrod spring 294 pushes the rim 293 against a ledge (not shown) of the engine block and pushes the washer 28 to secure the casing 27 relative to the props 13, 14. An overall length is set. But, with the pushrod seated on or in the lower castellation 24, 124, when the pushrods 91, 92 expand or contract (along with other connected features of the valvetrain and engine), the gap between the upper castellation 23, 123 and lower castellation 24, 124 can shift in the designed-for manner.

A lost motion mechanism can therefore comprise a castellation device 21, 211, 212. It is possible to have side-by-side mounting of castellation devices 21, 22, 211, 212 with duplication of castellation device 21 forming castellation device 22. Discussed more below, the castellation devices 21, 22, 211, 212, when duplicated, can be oriented to facilitate simultaneous actuation, as by having actuation pegs 231, 221 pointing in opposed or dissimilar directions.

Castellation devices 21, 22, 211, 212 can comprise a casing 27. A first linear slot 271 can set a position of the upper castellation 23, 123 and can provide a travel limit for the actuation peg 231. The rotary motion of rotary actuator 31 can translate into linear motion by being guided by the first linear slot 271. Casing 27 can comprise a second linear slot 272 perpendicular to the first linear slot 271. Anti-rotation peg 241 can be guided in the second linear slot 272 so that the valve lift profile can be "lost" in the second linear slot 272 when the castellation device is in the unlocked position. For ease of manufacture, first linear slot 271 can overlap with the second linear slot 272 on the tubular body 275. Or, other arrangements can be had to facilitate assembly or packaging such that there can be no overlap of the first and second linear slots 271, 272.

An upper castellation 23, 123 can comprise an upper body 23. The actuation peg 231 can be staked, welded, screwed, co-molded, or otherwise affixed or formed with the upper body 233. Actuation peg 231 extends from the upper body 233 into the first linear slot 271. An upper edge 237 of upper body 233 can abut the top 274 of the casing 27. Spaced upper teeth 232 extending from the upper body 233. The spaced upper teeth 232 form spaced upper gaps 234 therebetween. A height-setting tooth 235 can extend down to abut the washer 28 to ensure the braced positioning of the upper castellation 23 in the casing 27. A spacer 25, 125 can be used to brace the upper castellation 23. The spacer 25 can be annular to provide a more concentric positioning of the lower castellation 24, 124. A shim can form spacer 125. Using a spacer 25 reduces the friction of rotation of the upper castellation 23 because the height-setting tooth 235 does not need to drag against the lower castellation body 243. Upper edge 237, 2371 of upper body 233 can abut top 274 of casing 27 while lower edge 238, 2381 slides on the spacer 25, 125 or on the tops of lower teeth 242.

Lower castellation 24, 124 comprises a lower body 243. An anti-rotation peg 241 can extend from the lower body 243 into the second linear slot 272. Spacer 25 can surround the lower castellation 24, 124 and can comprise a pass-through for the anti-rotation peg. Spaced lower teeth 242 extend from the lower body 243. The spaced lower teeth 242 form spaced lower gaps 244 therebetween. As illustrated, long valve lift profiles can be "lost" in the longitudinally extending teeth and gaps. Radially extending teeth, such as inner and outer tooth and gap arrangements, can be substituted.

A spring 26, 261 can be included in a compartment 236 in upper body 233. Spring 26, 261 can be biased against the top 274 of casing 27 and the lower castellation 24, 124. A compartment 245, 2451 can be included in the lower body 243, 2431. Compartment 245 can be a light weighting feature with lubrication leak down. Compartment 2451 can additionally comprise a spring cup for spring 261.

Returning to the pushrod spring 294, it can press on the casing 27 and lower castellation 24, 124, preferably with the intervening washer 28 to form a cap or restrictive orifice for enclosing the parts of the castellation device 21, 22, 211, 212. There are several options for biasing the upper teeth 232 from the lower teeth 242. The springs 26, 261 form options. But, the pushrod springs 294 form an alternative or additional option. Pushrod spring 294 can constitute a "lost motion" spring, and pushrod sleeve 29 can constitute a spring retainer. An upper edge 292 of pushrod sleeve 29 can be clamped at the casing 27, as by a wire clip 291 or ring spring in inner groove 2762 in casing 127. The pushrod sleeve 29, and hence rim 293 is stable relative to the casing 127. So, the pushrod 91, 92 is well-guided as it pushes on a spigot 2463 of lower castellation 124. Spigot 2463 can comprise a knurl, ball, gothic or other shape, including a ball-and-socket arrangement. While the pushrods 91, 92 are cupped 93, 94, the ball-and-socket can be reversed. Lash and alignment can co-exist.

Or, a lost motion mounting area 246 can be integrated with the lower castellation 24. Upper edge 292 of pushrod sleeve 29 can be secured to a neck-down area 2461 of lower castellation 24. A groove 2462 is included in the neck-down area 2461 and wire clip 291 or ring spring can push out against upper edge 292 of pushrod sleeve 29. The force of pushrod spring 294 on rim 293 and washer 28 draws the lower teeth 242 of lower castellation 24 out from the upper gaps 234 after a lost motion event. The spring 26 can be optional in this arrangement. And, there is less resistance to the rotation of upper castellation 23 with the lower castellation 24 drawn by the pushrod spring 294. With the neck-down terminating with a spigot 2463, the pushrod 91, 92 can comprise cupped ends 93, 94 to engage reliably with the lower castellation 24. Lash and alignment can again co-exist.

So, it can be said that a pushrod sleeve 29 is mounted to the lower castellation 24. The pushrod sleeve can be configured with a pushrod spring 294 to bias the lower castellation 24 out of the casing 27. Or, it can be said that a pushrod sleeve 29 can be mounted to the casing 127. The pushrod sleeve 29 can be configured to guide a pushrod 91, 92 to push against the lower castellation 124. In either case, it can be said that a spigot extends from the lower castellation 24, 124 with the spigot configured to receive an end of a pushrod 91, 92.

In a valvetrain enabling cylinder deactivation ("CDA"), it can be desired to actuate two castellation devices 21, 22, 211, 212 at a time so that both intake and exhaust valves for a cylinder are deactivated together. So, an actuator 30 that can implement a rotation of both of the upper castellations 23, 123 is desired. Such an actuator 30 can comprise a rotary actuator 31 such as a motor, solenoid or other electrically-controlled device. Rotary actuator 31 can turn a rotatable axle 32. A plate 31*a* can be connected to the rotatable axle 32. Rotatable axle 32 and plate 31*a* can form a linkage. Linkage is connected to the rotary actuator 31. At least one movable arm 33, 34 is connected to the linkage to move the one or more actuation pegs 231, 221.

The teeth and gaps forming the upper teeth 232, upper gaps 234, lower teeth 242, and lower gaps 244 can be sized to respond to the strength and precision of the rotary actuator 31. Small teeth and gaps are illustrated. So, the rotary actuator 31 can be a small size and small strength. This helps with compactness and packaging. And, the one rotary actuator 31 can be installed in a compact space between the two rocker arms 11, 12. Yet, the one rotary actuator 31 can actuate both castellation devices 21, 22, 211, 212.

Figure 3A:
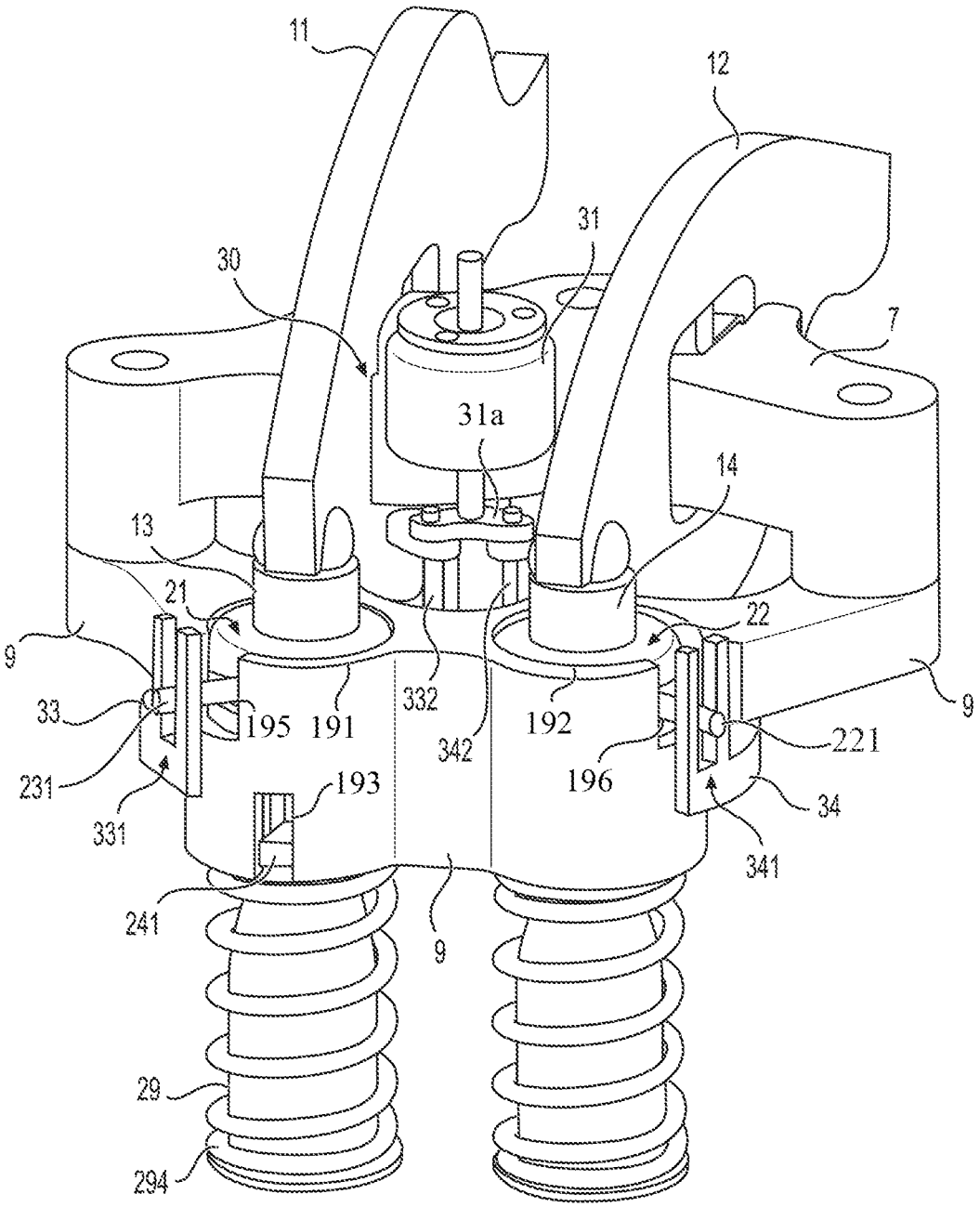
FIGS. 3A & 3B are views of actuation positions of an actuator.
Figure 3B:
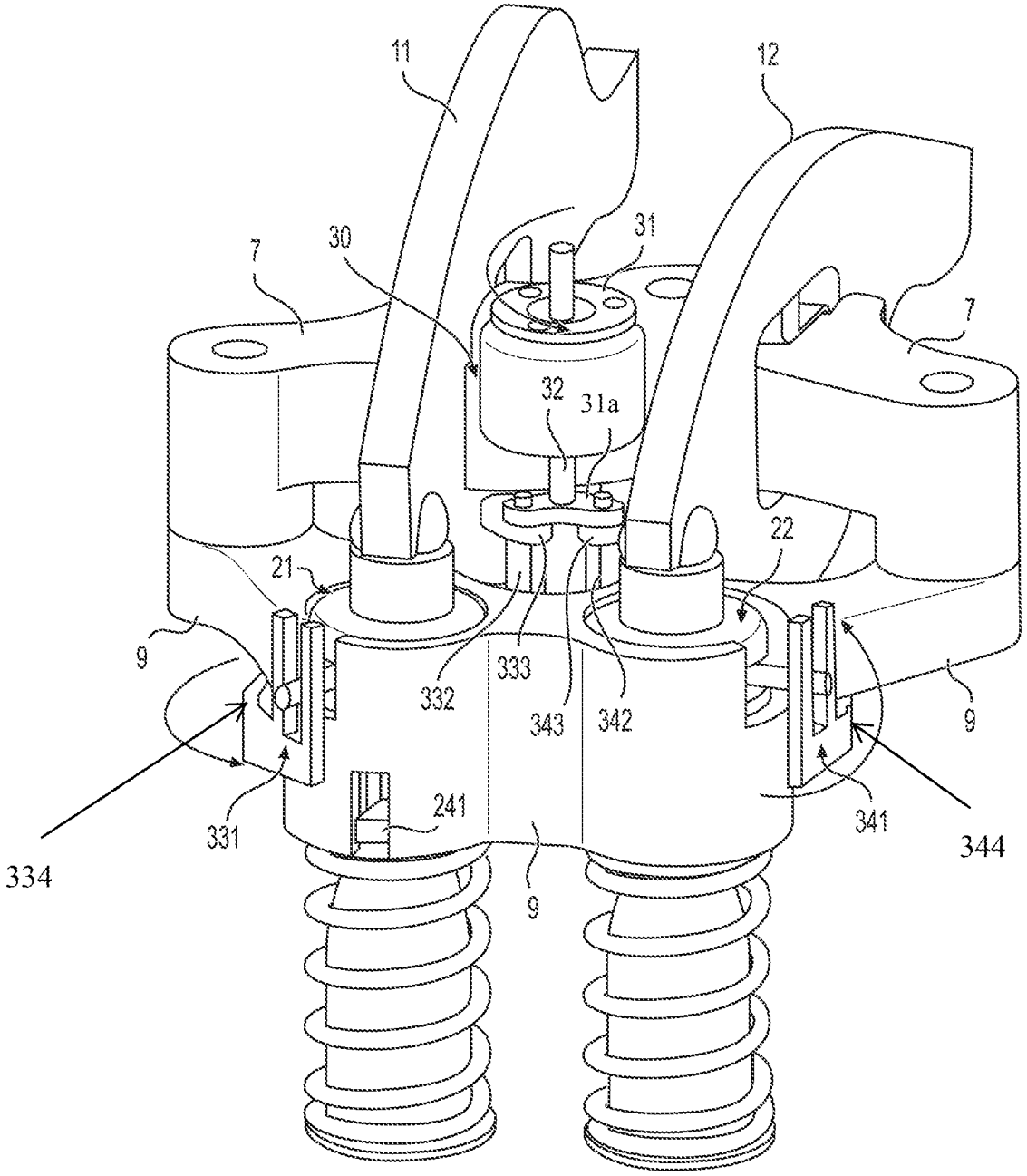
Figure 4A:
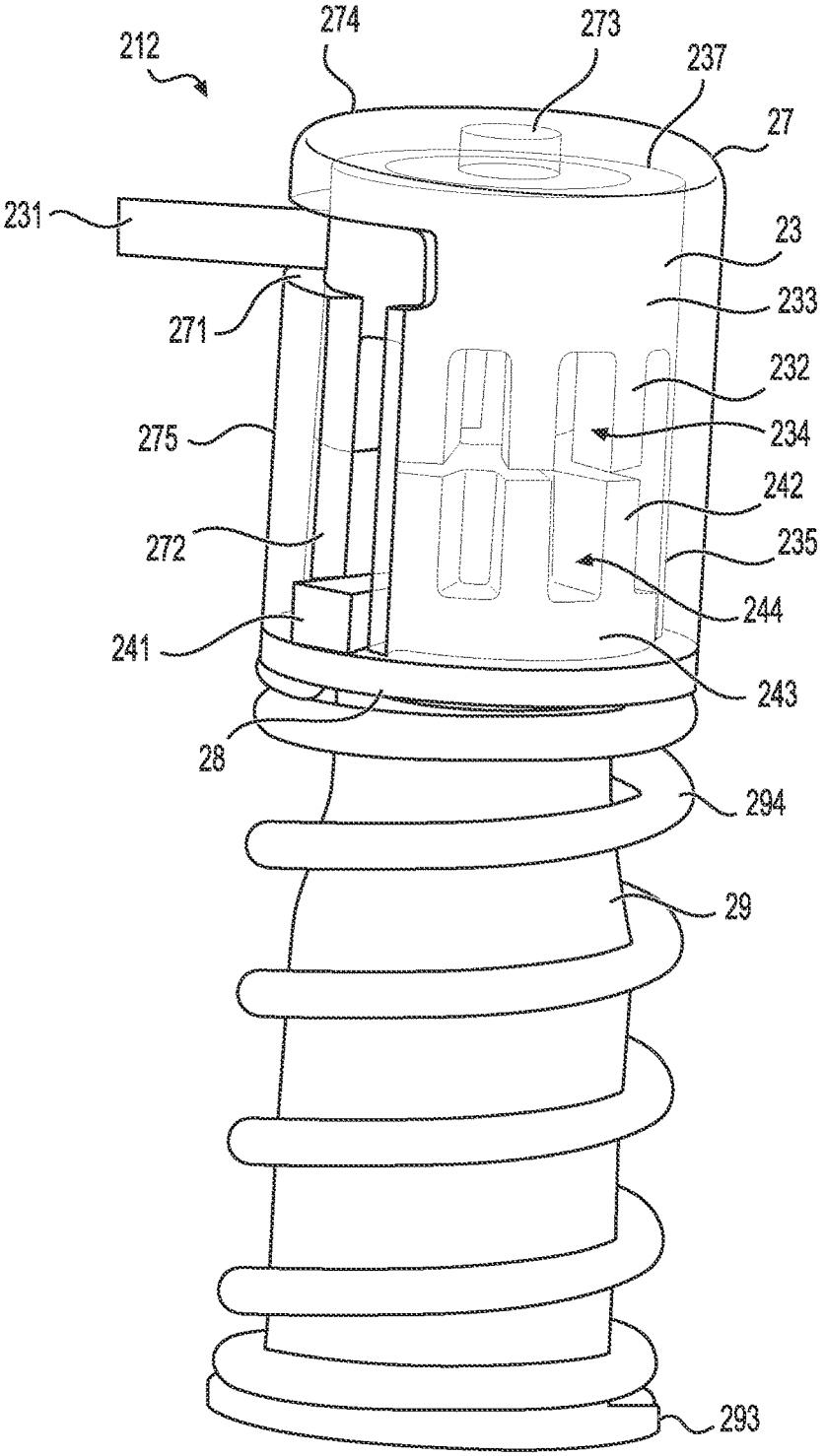
FIG. 4A shows a castellation device in a locked position.
Figure 4B:
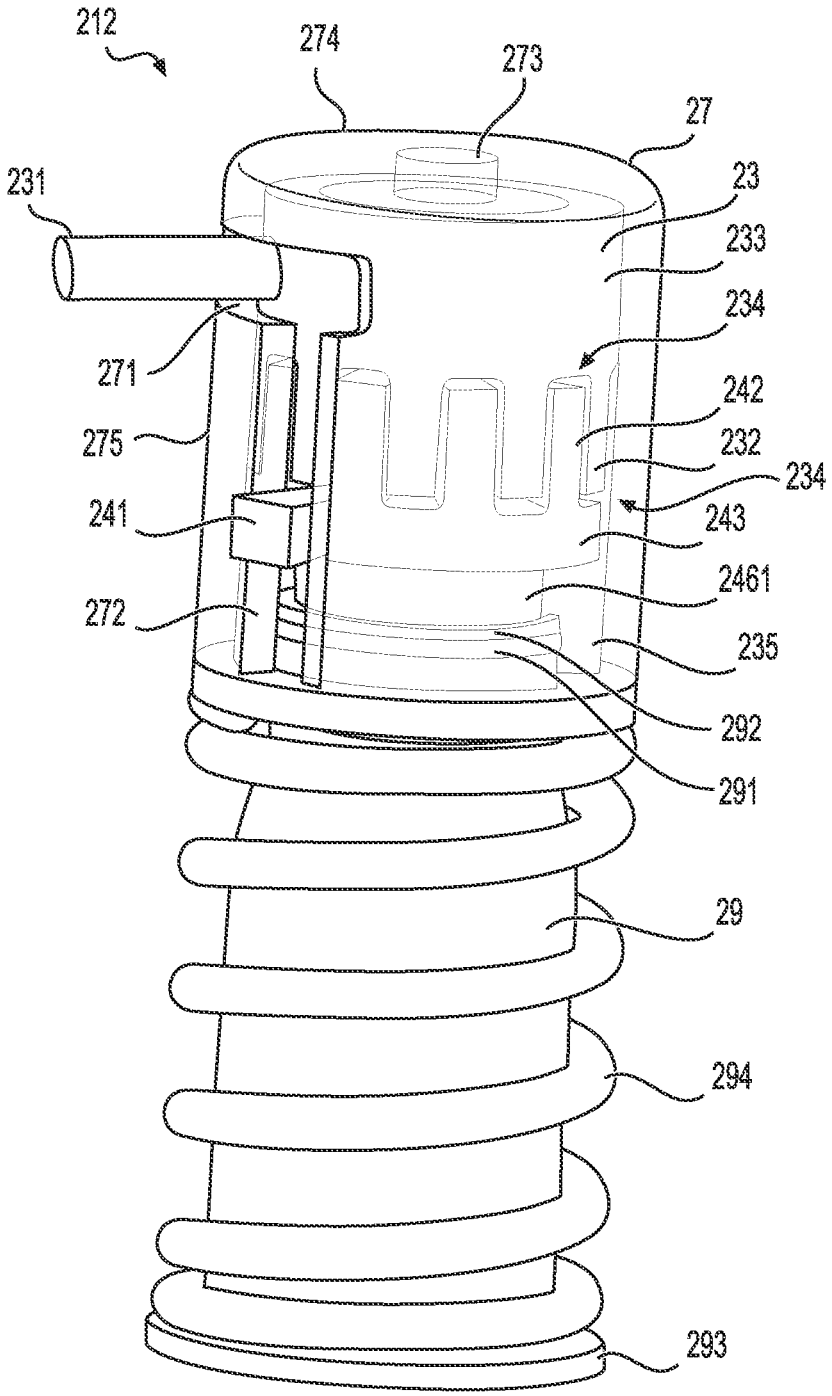
FIG. 4B shows a castellation device in an unlocked position.

One or more movable arms 33, 34 can be attached to the plate 31*a*. Bent ends 333, 343 can transition to vertical portions 332, 342. Vertical portions 332, 342 can make use of vertical space along the engine block 10. Vertical portions 332, 342 can drop down so that a bent portion 334, 344 can dip below a mounting portion of the castellation carrier 9. Bent portions 334, 344 can encircle the casing 27 and receptacle portions 191, 192. Movable arms 33, 34 can be configured to swivel to move the actuation pegs 231, 221. The movable arms 33, 34 can comprise forked ends 331, 341 configured to move on the actuation pegs 231, 221 as the movable arms 33, 34 swivel. The forked ends 331, 341 permit some "play" during actuation. The actuation pegs 231, 221 can rotate the respective upper castellations when the forked ends 331, 341 push or pull on the actuation pegs 231, 221. And, the forked ends 331, 341 can move along the actuation pegs 231, 221 during this pushing or pulling during the motion of the rotary actuator 31. The forked ends 331, 341 permit a degree of relative motion and flexibility during the transfer of actuation forces. With the efficient use of vertical space, as by the vertical portions 332, 342, and the efficient use of lateral space, as by the swiveling bent portions 334, 344, a small footprint and compact package is achieved. The arrows in FIG. 3B indicate that rotation of rotary actuator 31 causes rotation of forked ends 331, 341 which are engaged to rotate the actuation pegs 231, 221.

The first linear slot 271 guides the actuation peg 231 when the actuator 30 actuates to rotate the upper castellation 23, 123. A drive mode, or locked position, transmits a cam lift through the castellation devices 21, 22, 211, 212. The spaced upper teeth 232 align face-to-face with the spaced lower teeth 242 when the castellation device is in a locked position. A lost motion, or cylinder deactivation mode, can be achieved when the castellation device is in an unlocked mode. A cam lift is absorbed by the castellation device without transmitting the cam lift to the valves 1-4. When the spaced lower teeth 242 are aligned to slide in the spaced upper gaps 234, the castellation device 21, 22, 211, 212 is in the unlocked position. The anti-rotation peg 241 is slidable in the second linear slot 272 when the castellation device 21, 22, 211, 212 is in the unlocked position. It can be said that the first linear slot 271 guides the actuation peg 231 and locks the vertical position of the upper castellation 23, 123.

A single castellation device can be included in a valvetrain or, as illustrated, a pair of castellation devices 21, 22, 211, 212 can be included in a valvetrain. Or, a pair of castellation devices 21, 22, 211, 212 can be included per each pair of pushrods 91, 92. So, it can be possible to have two intake castellation devices to two intake pushrods and two exhaust castellation devices for two exhaust pushrods. So, the systems and devices are scalable. But, a single actuator 30 can actuate two castellation devices, and the actuator 30 can comprise a simplified electromagnetic actuator. And, the actuator 30 can permit switching between locked and unlocked positions during low engine RPMs, because the actuator 30 can be electric. The electric line routing can be included in the tower, and this takes up a small space. The cylinder head portion of the engine block 10 requires little modification to house the carrier 9.

It can be said that the actuation pegs 231, 221 of each of the castellation devices 21, 22, 211, 212 has a corresponding movable arm 33, 34 connected to a linkage to move them. The linkage can comprise a plate 31*a* connected to a rotating axle 32 of a rotary actuator 31. The plate 31*a* can be configured to swivel the movable arms 33, 34. The actuator 30 can be configured to switch between simultaneously moving the actuation peg 231 and the second actuation peg 221 in a first rotational direction, and simultaneously moving the actuation peg 231 and the second actuation peg 221 in a second rotational direction.

A single carrier 9 or tower assembly can house the rocker arms 11, 12, the castellation devices 21, 22, 211, 212, and actuator 30. This makes for compact assembly and packaging.

Figures 5A, 5B, 5C:
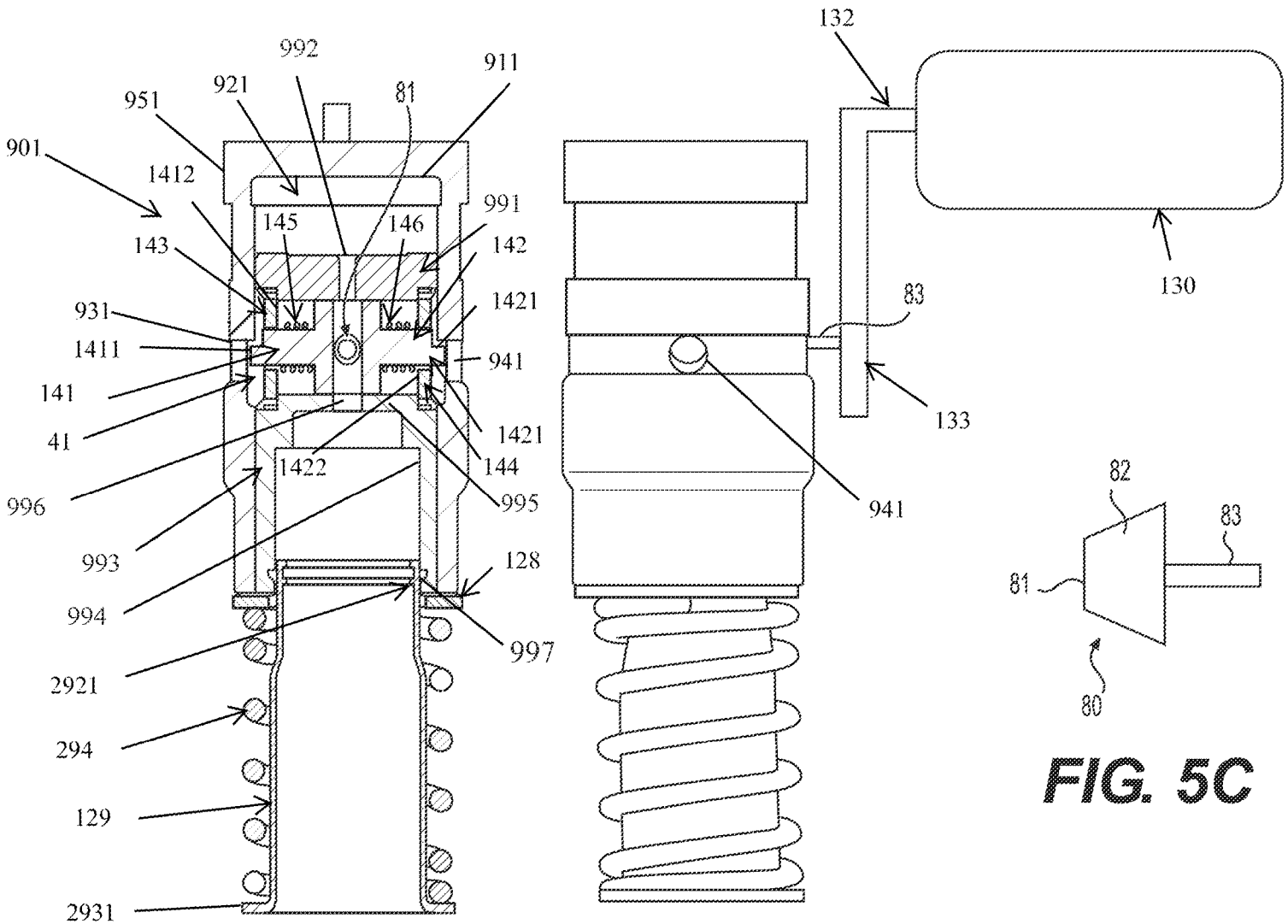
FIGS. 5A-5C show aspects of an alternative lost motion mechanism and actuator.

FIGS. 5A-5C show aspects for an alternative lost motion mechanism. A casing 901 comprises a tubular body 951, an inner chamber 921, a first window 931 and a second window 941. An upper limit 991 is seated within the casing 901. Upper limit 991 can slide in inner chamber 921 when the latch assembly 41 is unlatched. Upper limit 991 can be limited in its travel by the top 911 of the casing 901. Upper limit 991 can comprise a relief hole 992.

A lower limit 993 can also be seated within the casing 901. Lower limit 993 can slide in inner chamber 921 when the latch assembly 41 is unlatched. Lower limit 993 can comprise a relief hole 996 in a top portion 995. Top portion 995 can be a stepped-down portion of an inner chamber 994. Lower limit 993 can be configured to receive a pushrod 91, 92. Pushrod 91, 92 can be seated in the stepped-down portion and against the top portion 995. Lower limit 993 can also comprise an inner groove 997 for receiving a wire clip or the like to anchor a pushrod sleeve 129 at an upper portion 2921. Pushrod sleeve 129 can comprise a rim 2931 for seating a pushrod spring 294, also called a "lost motion" spring. Pushrod spring 294 can push against a washer 128. Washer 128 can provide a controlled orifice for assembling the lower limit 993 within the tubular body 951 of casing 901. Pushrod sleeve 129 can be mounted to the lower limit 993 and can be configured with the pushrod spring 294 to bias the lower limit 993 out of the casing 901. So, when the latch assembly 41 is latched with the latch ends 1411, 1421 in the first and second windows 931, 941, a drive mode is enabled. But with the latch assembly 41 is unlatched with the latch ends 1411, 1421 withdrawn from the first and second windows 931, 941, a "lost motion" can occur. The upper and lower limits 991, 993 slide in the casing 901 to absorb the valve lift profile. The lost motion spring force can re-set the latch assembly 41 by pulling the lower limit 993 away from the top 911 of the casing 901.

It is possible to form upper limit 991 and lower limit 993 from a single piece of stock, as by cross-drilling or casting a latch bore. An actuation bore could also be blind-bored or cast or otherwise formed into the piece of stock.

The latch assembly 41 can be mounted between the upper limit 991 and the lower limit 993. Latch assembly 41 can comprise a first latch 141 and a second latch 142 biased towards one another. Plugs 143, 144 can be mounted to guide first and second latches 141, 142. Latch ends 1411, 1421 can be stepped or otherwise shaped to engage in first and second windows 931, 941. But, latch springs 145, 146 can be biased against the plugs 143, 144 and against latch seats 1412, 1422 to withdraw the latch ends 1411, 1421 from the first and second windows 931, 941.

An actuation peg 80 can be mounted through the casing 901. The actuation peg 80 can be configured to slide to press the first latch 141 towards the first window 931 and to press the second latch 142 towards the second window 941. The actuation peg 80 can comprise a wedge 82 or cone body or taper body that can be pushed between the first and second latches 141, 142 to drive them apart. Wedge 82 can terminate with a tip 81 that sets the spacing between the first and second latches 141, 142. Actuation peg 80 can be withdrawn via embedded or integrally-formed rod 83 so that the latch springs 145, 146 can push the first and second latch 141, 142 together. Rod 83 can be integrated with an "L" bracket or the like. A vertical portion 133 can take advantage of vertical space in the engine block 10 for compact packaging. A linear portion 132 can be attached to a linear actuator 130, such as a solenoid, to provide linear motion that is translatable to rod 83. Like the rotary actuator 31, it is possible to package the linear actuator 130 between the rocker arms 11, 12 for an actuator with a small and efficient footprint in the valvetrain. Linear actuator 130 can be configured to slide the actuation peg 80.

Other implementations will be apparent to those skilled in the art from consideration of the specification and practice of the examples disclosed herein.

What is claimed is:

1. A lost motion mechanism, comprising:

a castellation device, comprising:

a casing, comprising:

a first linear slot; and a second linear slot extending perpendicular to the first linear slot;

an upper castellation disposed in the casing, the upper castellation comprising:

an upper body;

spaced upper teeth extending down from the upper body, the spaced upper teeth separated from each other via respective upper gaps; and an actuation peg extending out from the upper body into the first linear slot;

a lower castellation disposed in the casing, the lower castellation comprising:

a lower body;

spaced lower teeth extending up from the lower body, the spaced lower teeth separated from each other via respective lower gaps; and an anti-rotation peg extending out from the lower body into the second linear slot, wherein the second linear slot is configured to guide the anti-rotation peg in a direction perpendicular to the first linear slot.

2. The lost motion mechanism of claim 1, further comprising a spring biased against the casing and the lower castellation.

3. The lost motion mechanism of claim 1, further comprising a spacer surrounding the lower castellation.

4. The lost motion mechanism of claim 3, further comprising a pushrod sleeve mounted to the lower castellation, the pushrod sleeve including a pushrod spring configured to bias the lower castellation out of the casing.

5. The lost motion mechanism of claim 3, further comprising a pushrod sleeve mounted to the casing, the pushrod sleeve configured to guide a pushrod so as to push against the lower castellation.

6. The lost motion mechanism of claim 5, further comprising a spigot extending from the lower castellation, the spigot configured to receive an end of the pushrod.

7. The lost motion mechanism of claim 1, further comprising an actuator configured to rotate the upper castellation, the actuator comprising:

a rotary actuator;

a linkage connected to the rotary actuator; and a movable arm connected to the linkage so as to move the actuation peg.

8. The lost motion mechanism of claim 7, wherein the movable arm encircles the casing and swivels so as to move the actuation peg.

9. The lost motion mechanism of claim 7, wherein the movable arm comprises a forked end configured to move on the actuation peg as the movable arm swivels.

10. The lost motion mechanism of claim 7, wherein the first linear slot guides the actuation peg when the actuator rotates the upper castellation.

11. The lost motion mechanism of claim 10, wherein lower ends of the spaced upper teeth align with upper ends of the spaced lower teeth when the castellation device is in a locked position, and wherein the spaced lower teeth slide into the respective upper gaps when the castellation device is in an unlocked position.

12. The lost motion mechanism of claim 11, wherein the anti-rotation peg is configured to slide in the second linear slot when the castellation device is in the unlocked position.

13. A lost motion system comprising:

the lost motion mechanism of claim 7, wherein the actuator further comprises a second movable arm connected to the linkage so as to move a second actuation peg of a second castellation device.

14. The lost motion system of claim 13, wherein the linkage comprises a plate connected to a rotating axle of the rotary actuator, the plate configured to swivel the movable arm and the second movable arm.

15. The lost motion system of claim 13, wherein the actuator is further configured to switch between simultaneously moving the actuation peg and the second actuation peg in a first rotational direction, and simultaneously moving the actuation peg and the second actuation peg in a second rotational direction.

16. The lost motion mechanism of claim 1, wherein the first linear slot is configured to guide the actuation peg and to maintain a vertical position of the upper castellation.

17. A lost motion mechanism, comprising:

a casing comprising a first window and a second window;

an upper limit seated within the casing;

a lower limit seated within the casing;

a latch assembly mounted between the upper limit and the lower limit, the latch assembly comprising a first latch and a second latch biased towards one another; and an actuation peg mounted through the casing, the actuation peg configured to selectively slide between the first and second latch so as to press the first latch and the second latch towards the first window and the second window, respectively.

18. The lost motion mechanism of claim 17, wherein the lower limit is configured to receive a pushrod.

19. The lost motion mechanism of claim 17, further comprising a pushrod sleeve mounted to the lower limit, the pushrod sleeve including a pushrod spring configured to bias the lower limit out of the casing.

20. A lost motion system comprising the lost motion mechanism of claim 17 and a linear actuator configured to slide the actuation peg.

* * * * *